US008402896B1

(12) United States Patent
Hollerman et al.

(10) Patent No.: US 8,402,896 B1
(45) Date of Patent: Mar. 26, 2013

(54) HYBRID-LUMINESCENT MUNITION PROJECTILES

(75) Inventors: William Andrew Hollerman, Lafayette, LA (US); Noah Paul Bergeron, Ruston, LA (US); Brady Martin Broussard, Milton, LA (US)

(73) Assignee: University of Louisiana at Lafayette, Lafayette, LA (US)

( * ) Notice: Subject to any disclaimer, the term of this patent is extended or adjusted under 35 U.S.C. 154(b) by 619 days.

(21) Appl. No.: 12/260,583

(22) Filed: Oct. 29, 2008

Related U.S. Application Data

(63) Continuation-in-part of application No. 11/499,535, filed on Aug. 4, 2006.

(60) Provisional application No. 60/706,089, filed on Aug. 5, 2005.

(51) Int. Cl.
*F42B 30/02* (2006.01)
*F42B 12/38* (2006.01)

(52) U.S. Cl. ..... 102/513; 102/458

(58) Field of Classification Search ..... 102/513, 102/458
See application file for complete search history.

(56) References Cited

U.S. PATENT DOCUMENTS

| | | | | | |
|---|---|---|---|---|---|
| 2,592,434 | A * | 4/1952 | Krasnow | 102/513 |
| 2,770,736 | A * | 11/1956 | Krasnow | 376/162 |
| 3,757,632 | A * | 9/1973 | Bellinger | 89/1.1 |
| 3,875,864 | A * | 4/1975 | Ambrosini et al. | 102/513 |
| 4,020,765 | A * | 5/1977 | Glass et al. | 102/201 |
| 4,372,211 | A * | 2/1983 | Dante | 102/207 |
| 4,495,870 | A * | 1/1985 | Bell | 102/511 |
| 4,597,810 | A * | 7/1986 | Trickel et al. | 149/15 |
| 5,312,560 | A | 5/1994 | Somatomo et al. | |
| 5,415,151 | A * | 5/1995 | Fusi et al. | 124/56 |
| 5,773,752 | A * | 6/1998 | Blume et al. | 102/513 |
| 6,048,280 | A * | 4/2000 | Palmer et al. | 473/416 |
| 6,117,574 | A | 9/2000 | Watanabe et al. | |
| 6,298,841 | B1 * | 10/2001 | Cheng et al. | 124/56 |
| 6,497,181 | B1 | 12/2002 | Manole et al. | |
| 6,615,739 | B2 * | 9/2003 | Gibson et al. | 102/513 |
| 6,752,137 | B2 * | 6/2004 | Brunette et al. | 124/74 |
| 6,799,518 | B1 * | 10/2004 | Williams | 102/513 |
| 6,820,496 | B2 | 11/2004 | McElhanon et al. | |
| 6,880,467 | B1 | 4/2005 | Knapp | |
| 6,990,905 | B1 | 1/2006 | Manole et al. | |
| 7,004,813 | B2 * | 2/2006 | Zuloff | 446/175 |
| 7,040,308 | B2 * | 5/2006 | Ciesiun | 124/47 |
| 7,426,888 | B2 * | 9/2008 | Hunt | 102/513 |
| 7,870,851 | B2 * | 1/2011 | Mahany | 124/56 |
| 2004/0099173 | A1 | 5/2004 | Rector et al. | |
| 2004/0245504 | A1 | 12/2004 | Sage et al. | |
| 2005/0034627 | A1 | 2/2005 | Manole et al. | |
| 2005/0217527 | A1 | 10/2005 | Ciesiun | |

* cited by examiner

*Primary Examiner* — James Bergin
(74) *Attorney, Agent, or Firm* — Russel O. Primeaux; Kean Miller, LLP

(57) ABSTRACT

Novel hybrid luminescent ammunition (HLA) is provided. The HLA projectiles can include photoluminescent or triboluminescent material, or both. The photoluminescent and triboluminescent material can be placed at various locations on the projectile. In one configuration, the triboluminescent material that gives off light when the projectile impacts the target. In another configuration, a photoluminescent material provides a during flight and the triboluminescent material provides identification of target impact. In another configuration, the triboluminescent material is used to provide both the ballistic trace and the impact identification. Methods of making the HLA are also provided.

2 Claims, 13 Drawing Sheets

PRIOR ART

Tracer Bullet Compared to FMJ Bullet

PRIOR ART

Comparison of Conventional Round with Full Metal Jacket And Energetic Tracer with Full Metal Jacket

Figure 2
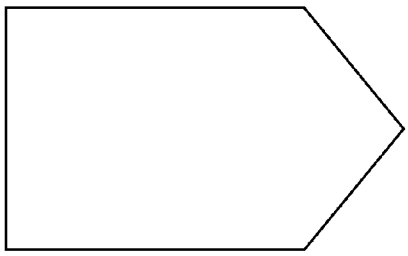
a. Standard Bullet
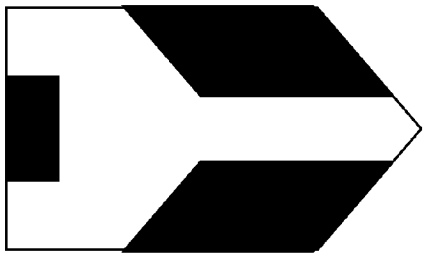
d. Luminescent Material in Rear Cavity and at Front for Showing Impact
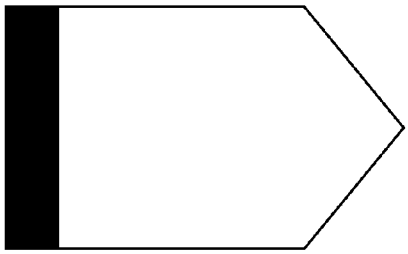
b. Luminescent Material at Rear
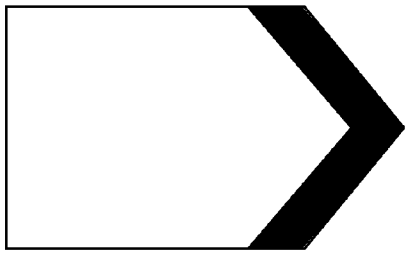
e. Luminescent Material on Front
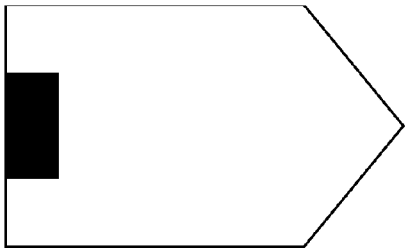
c. Luminescent Material in Rear Cavity
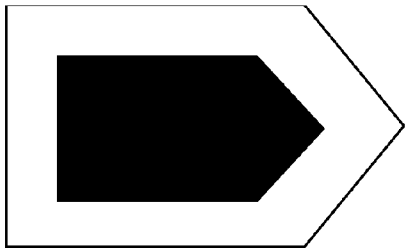
f. Tagging Bullet

Figure 6
Table 1 - Data for Projectiles with Varying Combinations of Luminescent Materials and Binders

| Luminescent Material (LM) | Binder | Luminescence Color |
|---|---|---|
| ZnS:Mn | PPMS (Poly Phenyl Methyl Siloxanc) | Yellow |
| ZnS:Mn | VHT Flame Proof Coating | Yellow |
| Nichia American Corporation NP – 2830 (exact material unknown) | VHT Flame Proof Coating | Blue-Green |
| $SrAl_2O_4$:Eu,Dy | VHT Flame Proof Coating | Blue |
| CaAl2O4: Eu,Nd | VHT Flame Proof Coating | Green |
| CaAl2O4: Eu,Nd | PPMS | Green |
| $SrAl_2O_4$:Eu,Dy | PPMS | Blue |
| CaAl2O4: Eu,Nd | PPMS | Blue-Green |

Figure 7
Table 2 – Information on Binders

| Binder Name | Type, Chemical, or Trade Name | Manufacturer |
|---|---|---|
| PPMS | Poly Phenyl Methyl Siloxane | Techneglas Technical Products |
| VHT Flame Proof Coating | Flame Proof, Clear | Caswell Inc. |
| 3 Minute Epoxy | Locktite | Henkel Consumer Adhesives |
| Blue | Hardman | Royal Adhesives and Sealants, LLC. |
| Red | Hardman | Royal Adhesives and Sealants, LLC. |
| Green | Hardman | Royal Adhesives and Sealants, LLC. |

Figure 8
Table 3 – Identification of Luminescent Material

| Chemical Symbol | Chemical Name | Description | Tradename and Manufacturer |
|---|---|---|---|
| ZnS:Mn | Zinc Sulfide: Manganese | Triboluminescent phosphor, short lived, pink in color, emits orange/red light | Phosphor Technology |
| $SrAl_2O_4$:Eu,Dy | Strontium Aluminate: Europium, Dysprosium | Luminescent phosphor, persistant, green in color, emits green light | Phosphor Technology |
| Eu:Tet | Europium: Tetrakis (Dibenzoylimethide)-trithyammonium | Triboluminescent phosphor, short lived, pink in color, emits orange/red light | Unknown |
| $Sr_4Al_{14}O_{25}$:Eu,Dy | Strontium Aluminate: Europium, Dysprosium | Luminescent phosphor, persistant, white in color, emits blue light | NP-2820 manufactured by Nichia Corporation |
| $SrAl_{20}O_4$:Eu,Dy | Strontium Aluminate: Europium, Dysprosium | Luminescent phosphor, persistant, white in color, emits blue-green light | NP-2830 manufactured by Nichia Corporation |

Figure 9
Table 4 - Triboluminescent Materials and Their Properties as Observed During Testing

| Triboluminescent Material | Triboluminescence Observed? |
|---|---|
| YAG:Eu | Yes, very faint |
| $La_2O_2S$:Eu | Bright |
| $Y_2O_3$:Eu | Very bright |
| $YVO_4$:Eu | Dim |
| $YPO_4$:Dy:Eu | Dim white flash |
| YAG:Ce | Dim yellow flash |
| $Y_3(Al,Ga)_5,O_{12}$:Ce | Dim |
| YAG:Dy | Dim flash |
| YAG:Tb | Dim |
| ZnS:Mn | 2nd Brightest flash tested |
| Eu:Tet | Brightest flash tested |

Figure 10
Table 5 – Information on Luminescent Materials

| Phosphor | Type or Trade Name | Manufacturer | Emission Color |
|---|---|---|---|
| ZnS : Mn | GL25/N-U1 | Phosphor Technology | Orange |
| UNKNOWN | NP-2830 | Nichia American Corporation | Green |
| $Sr_4Al_{14}O_{25}$: Eu,Dy | NP-2820 | Nichia American Corporation | Blue Green |
| $C_aAl_2O_4$: Eu,Nd | NP-2810 | Nichia American Corporation | Blue |
| $SrAl_2O_4$: Eu,Dy | HKM63D/L-L1 | Phosphor Technology | Green |
| $SrAl_2O_4$: Eu,Dy | HKM63D/L-L1 | Phosphor Technology | Green |
| ZnS : Mn | GL25/N-U1 | Phosphor Technology | Orange |
| ZnS : Mn | GL25/L-U1 | Phosphor Technology | Orange |
| Eu : Tet | UNKNOWN | UNKNOWN | Red Orange |

Figure 11
Table 6 – Configuration for Rifle Testing
(See Figure 12 – Table 7 for Results for Corresponding Lot Numbers)

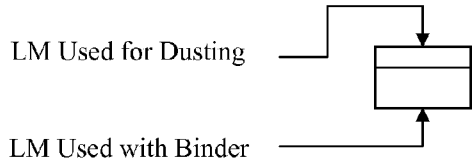

Notes:
LM: Binder ratio 1:1 by mass

| Lot No. | | LM Used for Dusting | Binder Used | LM Used With Binder | Cartridge |
|---|---|---|---|---|---|
| 1 | | NONE | Hardman Green | ZnS : Mn | 7.62 mm NATO |
| 2 | | $SrAl_2O_4$: Eu,Dy | Hardman Green | ZnS : Mn | 7.62 mm NATO |
| 3 | | $SrAl_2O_4$: Eu,Dy | Hardman Green | ZnS : Mn | 5.56 mm |
| 4 | | NONE | Hardman Green | ZnS : Mn | 5.56 mm |
| 5 | | ZnS : Mn | Hardman Green | ZnS : Mn | 5.56 mm |
| 6 | | $SrAl_2O_4$: Eu,Dy | Hardman Green | $SrAl_2O_4$: Eu,Dy | 5.56 mm |
| 7 | | NONE | Hardman Green | $SrAl_2O_4$: Eu,Dy | 5.56 mm |
| 8 | | ZnS : Mn | Hardman Green | $SrAl_2O_4$: Eu,Dy | 5.56 mm |

Figure 12
Table 7 – Results for Rifle Testing

| Lot Number | | Test Results (evaluated for trace and TL flash) |
|---|---|---|
| 1 | | Yes, Trace: Yes, TL Flash |
| 2 | | Yes, Trace (dim): Yes, TL Flash |
| 3 | | No, Trace: No, TL Flash |
| 4 | | No, Trace: Yes, TL Flash |
| 5 | | No, Trace: Yes, TL Flash |
| 6 | | No, Trace: No, TL Flash |
| 7 | | No, Trace: No, TL Flash |
| 8 | | No, Trace: Possible, TL Flash |

HYBRID-LUMINESCENT MUNITION PROJECTILES

CROSS REFERENCE TO RELATED APPLICATIONS

This application is a continuation-in-part of U.S. non-provisional application Ser. No. 11/499,535 filed on Aug. 4, 2006, which claims the benefit to prior U.S. provisional application Ser. No. 60/706,089 filed on Aug. 5, 2005.

FIELD OF THE INVENTION

This invention relates to luminescent material used in ammunition projectiles and their methods of manufacture. More particularly, the invention relates to luminescent materials which are photoluminescent or triboluminescent.

BACKGROUND OF THE INVENTION

Most modern military forces use energetic tracers based on technology that was developed in the early 1900s. Energetic tracer projectiles generate light through the use of energetic material imbedded in the rear of the projectile, similar to the effect of a burning road flare. Despite various technological advancements that have been made in tracers over the years since their introduction, energetic tracers nevertheless have several shortcomings. These shortcomings include:

1. The incendiary nature of energetic tracers makes them a fire hazard. The fires can be a safety hazard in training areas and can be an undesirable consequence in battle.
2. The tracers lose mass in flight, creating an inherent inaccuracy and lack of precision.
3. The material used for energetic tracers creates environmental and hazardous material problems.
4. The energetic tracers are difficult to manufacture.
5. Energetic tracers are bi-directional; meaning they can be seen by the shooter as well as the enemy.

Conventional energetic tracers contain pyrotechnic material, typically in a cavity at their base. The pyrotechnic material is ignited by the burning of the energetic component of the cartridge and burns brightly during flight. The usual practice is to load energetic tracers into an ammunition belt at a ratio of one tracer bullet per four rounds in ground-based guns, and one tracer per every two or three rounds in aircraft guns. Energetic tracers can never be a totally reliable indicator of a gunner's aim because the energetic tracers have different aerodynamic properties and weights when compared to standard rounds that are being fired with the energetic tracers.

Because the material used to manufacture energetic tracers is pyrotechnic, energetic tracer ammunition must be produced in a production line separate from the standard ammunition production line. In order to accommodate the tracer material, the length of an energetic tracer bullet is typically longer than a standard bullet of the same caliber. The increased length also adds to the complexity of manufacture because the tracer bullet takes up additional space in the cartridge that would otherwise be used for the propellant in a non-tracer cartridge.

The standard cartridge is made up of four components: primer, case, gun powder, and bullet. FIGS. 1A and 1B show cut-away views for certain cartridges. The primer is installed in the rear of the case in a cavity known as the primer pocket. A small hole, roughly one-third the diameter of the primer and known as the flash hole, is located in the center of the primer pocket. The flash hole establishes communication between the primer pocket and the body of the case that contains the gun powder and bullet. A full metal jacket that encases the lead core of the bullet is also evident in FIGS. 1 and 2.

Manufacturing of ammunition has numerous hazards associated with it. When coupled with energetic tracer manufacturing the problems increase greatly. Storage of energetic tracer material, product quality control, and worker health are only some of the obvious problems. Primer material and gunpowder expose manufacturers to some risk of explosion and fire, but these materials are absolutely necessary for the manufacturing of energetic tracer ammunition. Energetic tracer material increases the hazard to military ammunition manufacture. A non-energetic material with tracer properties would reduce the manufacturing risk by removing the toxic and flammable energetic tracer material from the equation.

Another problem associated with conventional tracers is that they typically leave behind a narrow cloud of burning material that can be up to about a meter long. While this increases the visibility of the tracer to the shooter, it also makes the tracer visible to the target and unfriendly observers in the surrounding area. Further, conventional tracers have resulted in fires on training ranges, as well as in the field, where fires are caused by the continued burning of the pyrotechnic material upon impact within the target area.

There have been attempts to produce tracers without the shortcomings mentioned above. For example, U.S. Patent Application Publication No. 2004/0099173 teaches the use of a light emitting diode (LED) and capacitor, instead of a pyrotechnic material, in an attempt to decrease tracer visibility from the target and surrounding area. Likewise, U.S. Patent Application Publication No. 2005/0034627 teaches the use of an electronic light source in lieu of the use of a pyrotechnic material. However, such attempts still result in a tracer bullet with a mass substantially different than the normal bullet.

Furthermore, U.S. Pat. Nos. 6,497,181 and 6,990,905 teach the use of materials in tracer ammunition whereby two chemicals must mix together to provide a chemical reaction subsequent to firing or launching of the bullet thereby creating visible light. This is known as chemoluminescent material. This tracer ammunition provides a trace of the path of the projectile and also serves as a marker whereby the projectile breaks apart upon impact, scattering the chemoluminescent material. However, the use of chemoluminescent materials in tracer ammunition requires a chemical reaction wherein at least two chemoluminescent materials need to react to form at least one new compound. Such tracer rounds require an added manufacturing expense because of the need to separate the individual chemicals prior to firing. This separation of chemicals may also take up space in the bullet making it either less massive, or making the bullet longer to provide for the chemical chambers. The separation of chemicals will also make the bullet more prone to damage during handling. In addition, after firing, the two chemicals must adequately mix in order to result in the desired luminescence. Also suitable environmental conditions may be needed to allow the chemical reaction to occur. Furthermore, the chemoluminescent tracers can only be seen in flight by way of a transparent window in the bullet, which has practical constraints due to the material limitations and installation of the window.

Consequently, there remains a need for tracer projectiles that are capable of overcoming substantially all of the shortcomings of conventional incendiary and chemoluminescent tracer projectiles.

SUMMARY OF THE INVENTION

In accordance with the present invention, a hybrid luminescent ammunition (HLA) round is provided. Novel methods for manufacture of HLA are also provided. HLA addresses many of the shortcomings of energetic tracer ammunition. HLA uses non-energetic luminescent material for creating the desired luminescent effect of the round. These non-energetic materials do not burn and have few known hazardous effects. Because the non-energetic luminescent materials do not need to be ignited by the propellant charge in the cartridge, the materials can be placed in various novel configurations on the projectiles.

In one embodiment, the HLA projectile is uni-directional. Uni-directional means that the tracer round can be viewed from only one perspective, that of the shooter viewing the target.

In another embodiment of the HLA projectile a tagging projectile is provided. The tagging projectile uses the hybrid luminescent material to mark or designate a target.

In another embodiment of the HLA projectile, an impact feedback projectile is provided. The impact feedback projectile gives off a flash of light upon impact with a target. This flash of light provides the shooter with positive feedback that the target has in fact been hit.

The above embodiments of the HLA may also be configured in various combinations, thereby allowing for tracing, tagging or impact feedback; all obtained by using the same projectile.

BRIEF DESCRIPTION OF THE DRAWINGS

FIG. 2 hereof depicts sectional views of various projectiles (bullets) cut along their longitudinal axis. The figures show the various locations on the bullet at which the luminescent material can be attached.

FIG. 6—Table 1 shows data for projectiles with varying combinations of luminescent materials and binders.

FIG. 7—Table 2 provides information regarding the binders used for the examples herein.

FIG. 8—Table 3 shows non-limiting examples of triboluminescent and photoluminescent materials suitable for use herein, and the properties of those materials.

FIG. 9—Table 4 shows non-limiting examples of triboluminescent materials and their properties as observed during testing.

FIG. 10—Table 5 provides further information on some of the luminescent materials used for the examples herein.

FIG. 11—Table 6 shows configurations of luminescent material and binder material used for rifle testing.

FIG. 12—Table 7 shows the results of the testing performed with the configurations described in Table 6.

DETAILED DESCRIPTION OF THE INVENTION

The present invention is directed to non-energetic tracer projectiles which incorporate one or more hybrid luminescent materials. The hybrid luminescent materials used in the present invention do not burn and have substantially fewer hazardous effects when compared to conventional tracer projectiles. Because the hybrid luminescent materials do not burn, the mass of a projectile with hybrid luminescent materials will remain substantially the same as the projectile travels downrange.

In accordance with the present invention, tracing projectiles can be produced that are uni-directional (only detectible by the shooter and not the target). Tagging projectiles can be made to mark or designate a target. Impact feedback projectiles give of a flash of light on impact with a target giving the shooter immediate recognition of a hit. Hybrid Luminescent Ammunition (HLA) combines the function of some or all of the mentioned luminescent projectiles; allowing for tracing, tagging, or impact feedback, or combinations thereof, from the same projectile.

Figure 1A:
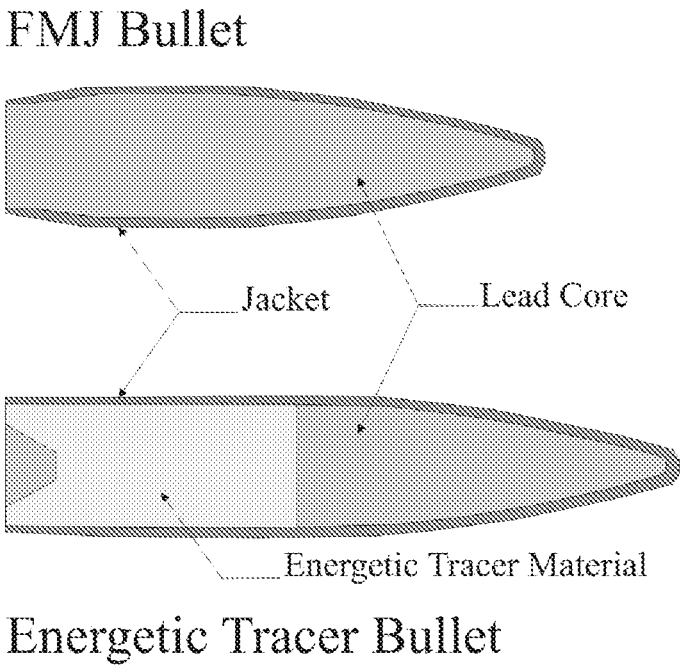
FIG. 1A hereof is a representation of a conventional standard full metal jacketed rifle bullet containing no tracer material compared to a conventional tracer rifle bullet containing an energetic material as the tracer material.

One problem with conventional energetic tracer projectiles is that they require longer jackets than those of non-tracer projectiles. FIG. 1 depicts both a conventional ammunition projectile with a full metal jacket (FMJ) surrounding the lead projectile and an energetic tracer munition having a cavity for the energetic tracer material. The energetic tracer FMJ is different from the conventional FMJ munition and cannot share a production line with the conventional FMJ projectile. One could use a standard FMJ exterior and use a smaller lead core so that there would be additional space in the jacket to form the cavity. However, this method is not acceptable because the shorter, lighter energetic tracer bullet would have a substantially different mass and therefore a different flight path than the conventional FMJ projectile of the same length.

Figure 1B:
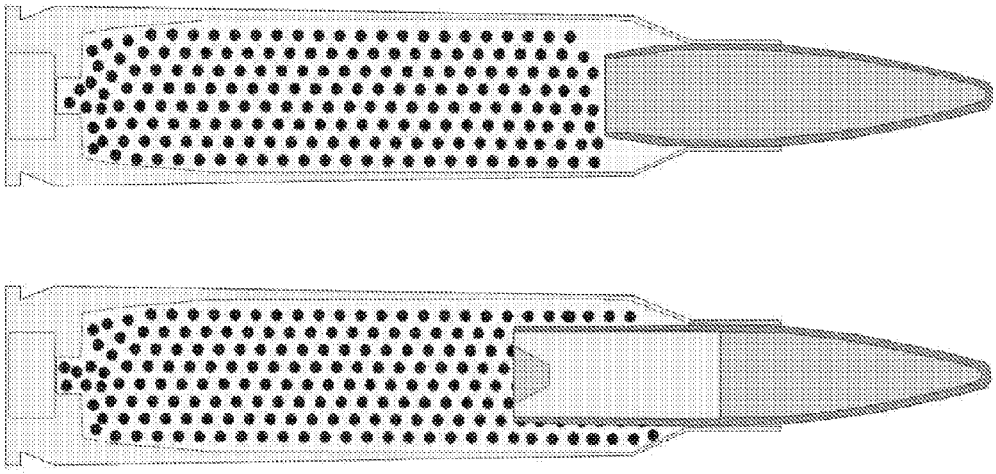
FIG. 1B depicts a comparison of a conventional round with a Full Metal Jacket to an energetic tracer with a Full Metal Jacket.

Another shortcoming with the longer overall length of the energetic tracer bullet is that the chance of a compression load is increased. A compression load occurs when the bullet squeezes the charge of gunpowder when the bullet is seated into the casing. FIG. 1B shows how the longer length of the energetic tracer bullet, because it protrudes further into the propellant space in the cartridge; increases the probability of a compression load.

For technology to be of use to a soldier on the battlefield it must be robust, light, and predictable. Military ground forces are always seeking to reduce the combat load of equipment and supplies carried by the individual soldier. With a normal tracer configuration, HLA provides the shooter with the ability to trace fire to a designated target without being detected by the target. With a feedback configuration, HLA provides the shooter with immediate visual feedback when the shooter's bullets strike the intended target. The HLA round can also be configured to provide the shooter with both the ability to trace fire to the target and receive visual feedback when the bullets strike the target. The HLA round can also be configured so that a hard target can be tagged with the HLA round, allowing for positive identification of the target at a later time.

Solid luminescent objects have been produced artificially since 17th century Europe. Scientific research into luminescence did not begin until the middle of the 19th century. Naturally occurring luminescent materials are found in living organisms such as fireflies, and may also be found in some minerals. Phosphors are materials that, when excited, emit "cold," or non-thermally induced, light. This type of cold, non-thermally induced, production of light is known as luminescence. Luminescence is used in myriad applications such as cathode ray tube televisions and fluorescent light bulbs.

Luminescence may be categorized by excitation source and emission lifetime. Luminescence that is due to a direct transition of less than approximately 10 ms decay time is referred to as fluorescence. Luminescence of greater than 10 ms decay time is known as phosphorescence. The greater decay time for phosphorescence is due to the existence of intermediate, metastable states.

While those skilled in the art will be familiar with many types of sources that can be used to excite luminescent material, two sources relevant to the current invention are photons and mechanical stress. The luminescence that occurs from photons shall be referred to as photoluminescence. The luminescence that results from mechanical stress shall be referred to triboluminescence.

Photoluminescence is the excitation of luminescent material by exposing it to a light source (photons). Photons from the bluer or ultraviolet end of the light spectrum are more likely to induce fluorescence than photons from the red or infrared end of the light spectrum. For a given fluorescent material, the brightness of its photoluminescence is proportional to the brightness of the excitation source. Some classic examples of photoluminescence are the various "glow in the dark" plastics and paints used in toy manufacture, safety equipment and various other products.

Triboluminescence (TL) is a specific form of mechanoluminescence, and is the production of non-thermal, or cold, light from any type of mechanical action or application of stress to the luminescent material. The mechanisms of TL light are still not fully understood by those skilled in the art, but it is believed that TL is associated with asymmetric crystal structure. When mechanical forces are applied to TL material, crystal bonds are broken along planes with opposing charges, and when the bonds are reformed light is emitted as the charges pass through the separations created from the fracture. An example of TL may be found in the crystals used for real wintergreen flavored Lifesavers®. The blue green sparks that can be observed when the candy is chewed are actually TL light being emitted from the crystal breakdown in the sucrose.

When a round is fired, the temperature of the powder burning in the casing can reach approximately 2,000° C., with the highest pressures for some rifles (60,000 to 70,000 psi) creating the greatest temperatures. These temperatures produce ultraviolet and visible light, both of which can be used to excite photoluminescent material on the projectile. Luminescent material designed to produce a ballistic trace must have a decay time long enough to permit the bullet to reach its maximum effective range. In a particularly preferred embodiment, the decay time would be several seconds.

TL-based marking ammunition will be most effective when impacting at the highest velocities. As the TL-based projectile hits the target; it will encounter great forces that can serve as the mechanical stress needed for the TL material to luminesce. The applicants have also discovered that a projectile with properly positioned TL material, usually on the rear of the projectile, may also be used to generate a ballistic trace. It is believed that the TL material is stimulated by the great pressures encountered in the casing and the barrel of the firearm when the projectile is fired.

Different methods may be used to attach the TL or photoluminescent materials [the TL and photoluminescent material will be collectively referred to as luminescent material ("LM")] to the projectile. Similarly, various configurations and placements of LM on the projectile can be used as well. In some embodiments, a binder is used to attach the LM to the projectile. The selection of the binder is important because the binder must withstand the environment inside a firearm barrel during the firing sequence. However, a binder is not required to attach the LM to the projectile. One could also integrate the LM with the projectile by various mechanical configurations that could be used to contain the LM within the projectile as the projectile travels to the target.

Non-limiting examples of photoluminescent materials include strontium aluminate, strontium aluminate doped with europium, strontium aluminate doped with dysprosium, and a doped dysprosium, such as $SrAl_2O_4$:Eu,Dy (manufactured by Phosphor Technology) which emits a green light. A second material, NP-2820 (manufactured by Nichia Corporation), comprises the chemical composition $Sr_4Al_{14}O_{25}$:Eu,Dy and emits a blue light. Another photoluminescent material that may be used is NP-2830 (manufactured by Nichia Corporation), which comprises the chemical composition $SrAl_{20}O_4$:Eu,Dy and emits a blue-green light. The above photoluminescent materials are merely examples. It is within the scope of this invention to use other photoluminescent materials. Table 5 provides further information on some of the luminescent materials used for the examples herein.

Although a binder is not required, the luminescent materials of this invention can be used with a binder to help secure the luminescent material to the projectile. Preferred binders are polymer-based materials, and epoxy-based materials are particularly preferred. Such epoxy-based binders are available from Royal Adhesives & Sealants, LLC and Hardman®. The Hardman® Double/Bubble® Epoxy binders are two-component curing epoxy resins comprised of an uncured epoxy resin as a first component and a hardener, preferably an amine resin as a second component. The exact compositions of thefirst and second components of the Hardman® Double/Bubble® Epoxy binders are not publicly available. Uncured epoxy resins are organic substances or mixtures of organic substances that generally contain two or more epoxy groups per molecule and that generally can be cross-linked by reaction of those epoxy groups to form thermoset compositions. Preferred types of epoxy resins include the bisphenol A/epichlorohydrin resins obtainable from "bisphenol A" [(2,2-bis-(4-hydroxyphenyl)-propane)] and epichlorohydrin in the presence of sodium hydroxide. Table 2 provides information regarding the binders used for the examples herein. All of the binders used herein are commercially available from the manufacturers listed in Table 2.

Commercially available epoxy resins generally have a relatively low molecular weight and are converted into higher molecular weight materials by chemical reaction with use of the hardener, which promotes crosslinking of the resin. The term "uncured epoxy resin" shall refer to an epoxy resin that has not been crosslinked while "cured epoxy resin" shall refer to a crosslinked resin.

Non-limiting examples of triboluminescent and photoluminescent materials and their properties suitable for use herein are shown in Table 3. One skilled in the art could also use radioluminescent material to create hybrid luminescent ammunition. In radioluminescent material, the excitation source for the luminescent phenomenon is radiation, such as beta particles. One limitation of radioluminescent material is that it is usually always "on" and is more difficult to activate by selective excitation.

To create an HLA projectile that luminesces only when the projectile comes into contact with the target, TL materials will be used and placed on the projectile so that the TL material will impact the target. TL materials, as previously mentioned, are those wherein light is emitted by the breaking of asymmetrical bonds in a crystal when that material is subject to some type of mechanical stress. Non-limiting examples of triboluminescent materials and their properties as observed during testing are shown in Table 4.

The present invention can better be understood with reference to the non-limiting examples set forth below.

EXAMPLE 1

Various mixtures of luminescent materials and binders, as indicated in Table 1, were prepared and used to coat 5.56 mm projectiles. The rear of each projectile was painted with the various combinations of LM and binder mixtures as shown in Table 1, wherein the ratio of LM:binder was 1:4. The only alteration made to the projectiles was the addition of these painted mixtures. The painted projectiles were then oven cured at a temperature of about 160° C. for at least an hour.

The projectiles in Table 1 were put through two tests. In the first test each of eight modified 5.56 mm projectiles was fired into a sandbag in daylight at close range to determine the ability of the various LM and binder mixtures to adhere to the projectiles. One projectile fragment was recovered for each of the fired rounds. Results showed that each recovered bullet still contained varying amounts of LM attached to the now-fragmented bullet.

In the second test the projectiles were fired in a 275 yard darkened indoor range. Two projectiles with the NP-2830 luminescent material and the PPMS binder produced observable luminescence upon impact. One projectile with the NP-2830 luminescent material and the VHT Flame Proof Coating binder produced observable luminescence during flight and at impact.

EXAMPLE 2

Two combinations were chosen for this example. The first combination was NP-2830 luminescent material with the PPMS binder. The second combination was NP-2830 luminescent material with the VHT Flame Proof Coating binder. Both 5.56 mm and 35 caliber Whelen projectiles were used in this example. The 5.56 mm projectiles were unaltered bullets pulled from factory loaded ammunition. LM was mixed with binder at a 1:4 (LM: binder) mass ratio. The only alterations made to the bullets were the addition of the LM and binder mixtures which were applied to the boat tail rear of each projectile. After the mixture was added, the bullets were oven cured at a temperature of about 160° C. for one hour.

The 35 caliber Whelen bullets were unaltered bullets pulled from factory loaded ammunition. LM was again mixed with binder at a 1:4 (LM: binder) mass ratio. The only alterations made to the bullets were the addition of the paint mixtures which were applied to the cavity at the base of the bullet. Once painted, the bullets were oven cured at a temperature of about 160° C. for one hour.

All of the coated 35 Whelen projectiles were tested fired for the purpose of verifying binder adhesion properties. All were fired in daylight at 25 yards into a stack of phone books; which permitted the recovery of expended projectiles. It was found that, depending on application technique, 25% to 85% of the applied LM remained on the bullet after recovery. From this test one could conclude that the PPMS binder was successful in keeping the LM adhered to the projectile.

EXAMPLE 3

Pneumatic guns were used to test the projectiles in this example. Pneumatic guns use compressed air or carbon dioxide gas to propel the projectile. Because the pneumatic guns did not burn a propellant; the luminescence that occurred could not be attributed to the effect of a burning propellant on the round as it was fired.

Three different size projectiles were chosen for this experiment. 17.7 cal pellets, 22 cal pellets, and 68 cal pellets. A pellet is a term usually used to define the bullet or projectile launched from a pneumatic gun. The 17.7 cal and 22 cal pellets are made of lead and have a hollow base similar to the design of a badminton shuttlecock. This hollow base was ideal to contain the LM and binder mixture. The 68 cal pellets were designed and manufactured with the intention of launching them from a modified paintball gun. These large slow moving pellets were to allow for a demonstration of the technology in situations where an energetic firearm demonstration would be impractical. These 68 cal pellets were turned on a lathe from solid black plastic rod stock. A paintball gun was modified to allow the launching of these pellets because the pellets are longer than standard paintballs.

The 17.7 cal and 22 cal pellets were manufactured in much the same was as 5.56 mm projectiles of Examples 1 and 2 above. Two LM/binder combinations were tested. The first combination was NP-2830 luminescent material with the PPMS binder. The second combination was NP-2830 luminescent material with the VHT Flame Proof Coating binder. The cavity at the rear of each pellet was filled with the LM/binder mixture. The pellets were then oven cured at a temperature of about 160° C. for one hour.

Because the 68 cal pellets were plastic and could not withstand a curing temperature of 160° C., a binder other than PPMS was needed; one that did not require oven curing. Instead, the following binders were considered: 3 Minute Epoxy by Locktite; Hardman Blue; and Hardman Red. The Locktite and Hardman Blue were amber in color and appeared to inhibit the luminescent effect of the NP-2830 and Strontium Aluminate Europium, Dysprosium LMs. Hardman Red is nearly colorless and made for mixtures that were visibly brighter than mixtures made with any of the previous binders. Given the characteristics of the binders and LMs under consideration for the 68 cal pellets; the decision was made to apply a mixture of Strontium Aluminate: Europium, Dysprosium as the LM and Hardman Red as the binder to all of the 68 cal pellets in this example.

The testing methods for the pneumatic pellets had to be different than methods used with cartridges which include a propellant. As mentioned above, for a cartridge with a propellant, the light generated by the burning propellant is used to charge the LM. Pneumatic guns do not use a burning propellant; therefore charging of the photoluminescent material was performed manually. Before a pellet tracer was fired from the pneumatic gun, the LM was charged with a white or UV light source. The pellet was then promptly fired from the pneumatic gun, allowing for the LM trace to be observed.

All pellets tested in this example produced a visible trace throughout their flight paths in a darkened indoor facility, with a target set at 25 feet. The 17.7 cal pellets had been modified with the most successful LM and binder mixtures of Examples 1 and 2 hereof. A small group of 22 cal pellets made in a similar fashion were also tested and exhibited the same positive results as the 17.7 cal pellets. The 68 cal pellets were also tested and the results were also successful with a number of distinct traces caught on video.

EXAMPLE 4

The success of the low pressure pneumatic testing of Example 3 allowed for more clearly identifying the pressure and velocity boundaries of the luminescent technology of this invention. To develop low pressure/low velocity pneumatic projectiles and advance directly to high pressure high velocity projectiles would not allow for complete exploration of the full working range of the technology. The 45 Automatic Colt Pistol (ACP) and 9 mm pistol cartridges were selected to provide for incremental testing. The 45 ACP projectile has one of the largest rear profile available in the range of pistol cartridges. It operates at a roughly 18,000 psi with a velocity of approximately 1,100 ft/s. The large 45 ACP projectile allowed for wide levels of experimentation in the tracing and tagging concept. Large 45 cal projectiles allowed for the machining of cavities to hold LM. This testing in this example would allow for further exploration of the triboluminescent (TL) and tagging technology.

The 9 mm projectile has a smaller rear profile than the 45 ACP projectile and operates at approximately 32,000 psi with a velocity about 1,300 ft/s. However, these differences were not nearly as great compared to rifle cartridges. Therefore, the 9 mm also allowed for testing at pressures and muzzle velocities less than those found in high-powered rifles.

Figure 3:
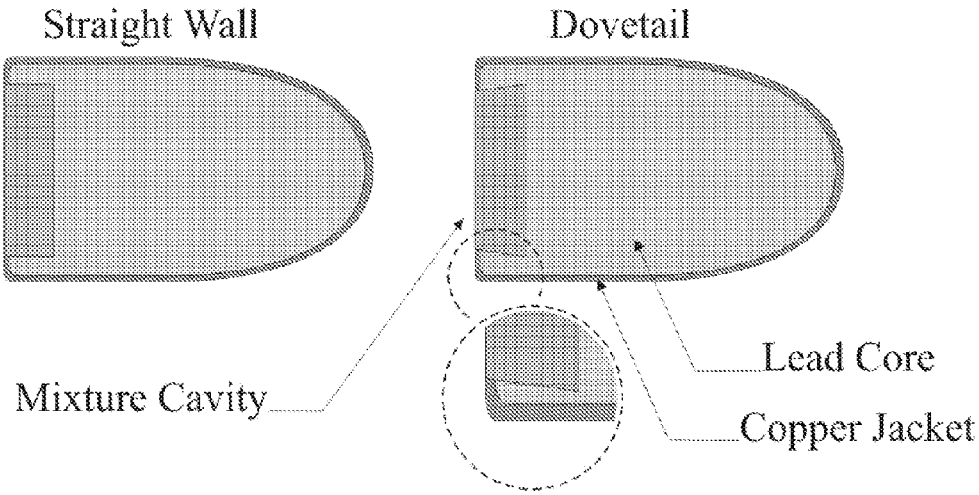
FIG. 3 contains sectional views of two similar bullets cut along their longitudinal axis. The figures show the luminescent material in a cavity at the base of bullet. One drawing shows a cavity having substantially straight walls. The other drawing shows the side walls of the cavity having a dovetail design to help secure the luminescent material.

In this example, projectiles were prepared in two steps. The first step was to machine the projectile with a rear cavity for acceptance of the LM/binder mixture. The LM/binder mixture was found to perform better when placed in a pocket or cavity in the projectile. It is preferred that a dovetail be used as opposed to a straight wall cavity, although both are within the scope of this invention. A dovetail cavity is larger in diameter at the bottom of its opening. FIG. 3 shows both a straight wall and dovetail walled cavity at the base of a projectile. The cavity, particularly the dovetail cavity, provides both mechanical and adhesive bonding for greater retention. The second step was the application of the LM/binder mixture to the projectile prepared in step one.

The LM/binder mixture for the projectiles in this example was Strontium Aluminate: Europium, Dysprosium mixed at a 1:1 mass ratio with Hardman Red or Hardman Green binder. Hardman Red is a fast cure binder with three minute working time. Hardman Green is a slow cure binder with a one hour working time. The majority of the projectiles in this example used Hardman Green.

After machining the projectiles in this example to form a rear cavity, the LM/binder mixture was applied to each projectile cavity. The 45 ACP tracer projectiles were test fired and a noticeable trace of light was detected with a less than 1% failure rate. The trace was not as bright as a conventional energetic tracer round. However the trace was clearly visible to the naked eye. The 9 mm tracer projectiles of this example were also test fired and a visible light was also observed. The LM/binder mixture of Strontium Aluminate Europium, Dysprosium mixed with Hardman Green at a mass ratio of 1:1 is preferred for the luminescent tracer projectiles in this example. The LM Zinc Sulfide Manganese is preferred for the TL/tagging projectiles.

EXAMPLE 5

Figure 4:
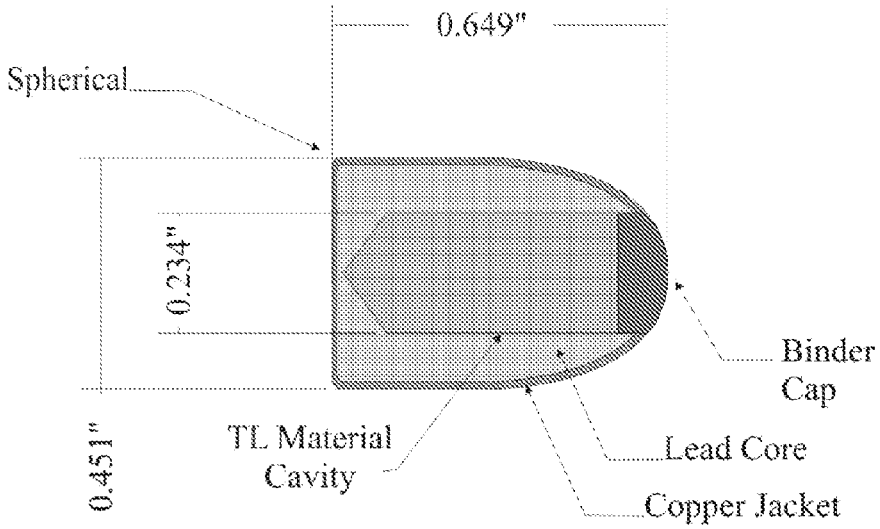
FIG. 4 hereof is a sectional view of a bullet cut along its longitudinal axis showing triboluminescent material (labeled as "TL") in a cavity within the bullet and capped with a suitable binder material.

Triboluminescent (TL)/tagging projectiles were prepared using 45 cal bullets. These bullets were designed to emit a TL flash of light on impact with a target. This TL material would also then tag the target by coating it with TL material. TL/tagging projectiles manufactured from 45 cal bullets required the machining of a cavity in the front of the projectile as shown in FIG. 4. This cavity was then filled with Zinc Sulfide: Manganese as the LM and capped with Hardman Red or Hardman Green to encapsulate the TL material. Limited TL/tagging experiments also included 12 gauge slugs. They were manufactured using the same methods as standard TL/tagging projectiles.

When the TL/tagging projectiles in this example were test fired, they produced an orange flash of light approximately 8 to 12 inches in diameter upon impact. The Zinc Sulfide: Manganese LM dispersed into a cloud that shimmered for a period of less than a second.

Figure 5:
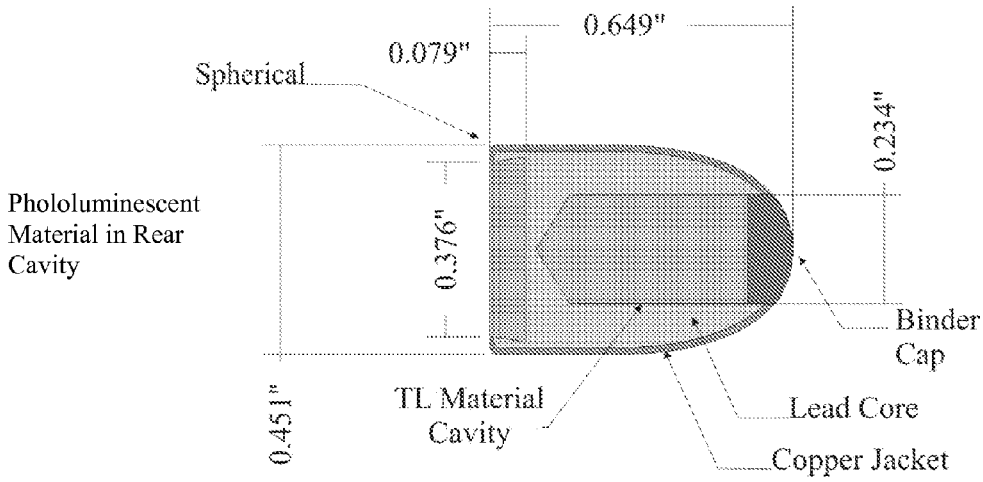
FIG. 5 hereof is a sectional view along the longitudinal axis showing one embodiment of an HLA projectile of the present invention. Photoluminescent material is located in a cavity at the base of the bullet and triboluminescent material is located in a cavity within the bullet and capped with a suitable binder material.

Combination photoluminescent and TL/tagging projectiles (45 ACP and 9 mm) were prepared in accordance with the procedures established in the above examples. These hybrid projectiles had rear cavities filled with a mixture of Strontium Aluminate: Europium, Dysprosium as the LM and Hardman Green Epoxy as the binder, mixed at a mass ratio of 1:1. The front cavity was filled with LM Zinc Sulfide: Manganese and capped with Hardman Red or Hardman Green as a binder. An example of a hybrid projectile is shown in FIG. 5.

When the HLA projectiles were test fired, they exhibited visible traces of green light in route to the target. Upon impact with the steel plate target, a bright orange flash was observed. Additionally, examination of the target showed evidence of the TL material being deposited onto the surface of the target.

EXAMPLE 7

The experiment in this example was conducted to determine if triboluminescent material could be made to emit visible light during the flight of a projectile. This form of luminescent projectile does not rely on light generated from the burning of propellant to stimulate the luminescent material. Instead, the pressure from the environment of the barrel of the gun initiates the triboluminescent phenomenon.

7.62 mm projectiles were used in this example. Two techniques were used to apply the TL material to the projectiles. Technique One is a mixture application. The LM is mixed with a binder and applied to the projectile. Technique Two is a mixture application with dusting.

In Technique One the binder is prepared according to the manufacturer's instructions. The binder and LM are then mixed at a 1:1 ratio according to mass. The resulting mixture is then applied to a cavity at the rear of the projectile. The cavity may be as shown in FIG. 2B or 2C.

Technique Two includes all the steps of Technique One. After the LM mixture has been applied to the projectile cavity, but prior to the curing of the mixture, a further step is performed. LM, in pure powder form with no addition of binder, is sprinkled over the projectile base, completely covering the surface. The powder form LM is piled up to created a layer of LM powder that is a minimum of 2 mm thick. After the LM mixture and sprinkled LM layer have reached the designated cure time, the excess LM is dusted off with a brush or some other similar tool. After the dusting step; the final thickness of the LM layer may be less than 2 mm. The excess LM can be collected and reused for mixtures or for dusting.

The purpose of the sprinkling was to provide pure LM at the rear of the projectile instead of LM whose strength had been diluted by the binder. It is believed that the luminescence from the pure LM material on the sprinkled layer at the rear of the projectile provides stronger luminescence, especially for triboluminescent material. However, an unexpected benefit was realized from the sprinkling. The sprinkled layer served to prevent the gunpowder from reacting with the binder that was below the sprinkled layer. The prevention of such a reaction is important to the stability of the ammunition when it is in storage, especially when the storage is for extremely long periods of time.

It has been discovered that Technique Two creates a projectile with unique properties depending on the type of LM used. The use of more than one LM at the same or at various locations on the projectile can produce a projectile with dual or multiple luminescent properties.

Specific testing was performed with 7.62 mm cartridges to determine if TL material would reliably luminesce during flight. Zinc Sulfide: Manganese was used as the TL material. The results are shown in Tables 6 and 7. Testing focused on the bond between the projectile and the LM/binder mixture. If the LM/binder mixture was not remaining attached to the projectile for the entire duration of its flight tracing, TL light would not be observed throughout the flight of the projectile. The projectiles were captured in order to examine them for retention of the LM and binder. Numerous 7.62×39 mm projectiles were fired into a target at 50 and 100 yard ranges and captured using a buffer device and a water tank. The captured projectiles were in nearly perfect condition. It was observed that some of the tracer bullets would separate from the LM mixture after the bullet had entered the water tank, presumably due to the impact with the water. It is believed that for these projectiles, the LM mixture was squeezed out of the bullet cavity shortly after entering the tank. Even in these cases, both the LM wafer and its corresponding projectile were captured at the target. The recovery of the bullets that retained their LM/binder mixture, as well as those for which the LM/binder mixture became detached at the target; proved that the projectiles with the LM/binder mixture reached the target, even after being shot from a firearm.

With positive evidence that the LM/binder mixture had remained attached to 7.62×39 mm projectiles, a number of various recipes were prepared in accordance with Table 6. Table 6 shows how the bullets were configured. Each configuration is designated by a lot number.

Table 7 shows the results of the test that were preformed at a 100 yard rifle range with the projectiles shown in Table 6. Traces were dim but visible with the naked eye. High velocity projectiles produces large TL flashes compared to low velocity suggesting that the TL effect increases with the increased velocity. The lot numbers for the test results in Table 7 correspond with the lot numbers shown in Table 6.

One skilled in the art could also use the HLA material for shotgun ammunition. Shotgun ammunition falls into two general configurations, slugs and buckshot. For the slug configuration, the slug functions much like the projectile for conventional rifle ammunition. For shotgun slugs, those skilled in the art could adapt the various placements of the HLA material on projectiles to shotgun slugs. Buckshot loads contain spherical pellets. Those skilled in the art could also adapt the methods and materials recited herein to coat the buckshot pellets with HLA materials.

The scope of the invention is set forth in the following claims.

What is claimed is:

1. A luminescent projectile comprising:

(1) a projectile body and an effective amount of photoluminescent material attached to said projectile body wherein said photoluminescent is positioned on said projectile to provide a directional luminescent light source directed substantially toward the rear of the projectile as said projectile travels downrange after being fired;

(2) wherein said photoluminescent material is positioned in a cavity at the rear of said projectile such that the observed luminescence of the projectile is substantially limited to the perspective of an observer at the rear of said projectile as said projectile travels downrange after being fired; and (3) wherein said photoluminescent material comprises:

(a) a mixture of said photoluminescent material and binder material, said mixture being attached to said rear of said projectile, and (b) a layer of said photoluminescent material in powder form over said mixture of luminescent material and binder material.

2. The luminescent projectile of claim 1 wherein said cavity comprises:

(1) a rear portion;

(2) a front portion; and (3) wherein the average diameter of said rear portion is less than the average diameter of said front portion.

* * * * *